US008801582B2

(12) United States Patent
Huang et al.

(10) Patent No.: US 8,801,582 B2
(45) Date of Patent: Aug. 12, 2014

(54) TREADMILL

(75) Inventors: Hsuan-Fu Huang, ChangHua County (TW); Shih-Wei Liu, ChangHua County (TW)

(73) Assignee: Dyaco International Inc., Taipei (TW)

( * ) Notice: Subject to any disclaimer, the term of this patent is extended or adjusted under 35 U.S.C. 154(b) by 198 days.

(21) Appl. No.: 13/484,833

(22) Filed: May 31, 2012

(65) Prior Publication Data

US 2013/0231219 A1 Sep. 5, 2013

(30) Foreign Application Priority Data

Mar. 5, 2012 (TW) ..... 101107375 A

(51) Int. Cl.
*A63B 22/02* (2006.01)
*A63B 22/00* (2006.01)
*A63B 71/00* (2006.01)

(52) U.S. Cl.
USPC ..... 482/54; 482/51

(58) Field of Classification Search
CPC ..... A63B 22/00; A63B 22/0015; A63B 22/0023; A63B 22/02; A63B 22/0235; A63B 22/0242
USPC ..... 482/30, 32, 51–54, 908
See application file for complete search history.

(56) References Cited

U.S. PATENT DOCUMENTS 2,790,503 A * 4/1957 Kopczynski ..... 180/363
3,712,359 A * 1/1973 Willams ..... 152/158
4,102,423 A * 7/1978 Reid ..... 180/7.1
4,333,518 A * 6/1982 Frost et al. ..... 165/8
5,390,925 A * 2/1995 Wiltse ..... 473/160
5,651,754 A * 7/1997 Chen ..... 482/57
5,897,460 A * 4/1999 McBride et al. ..... 482/54
6,106,441 A * 8/2000 Chen ..... 482/57
6,171,216 B1 * 1/2001 Wang et al. ..... 482/54
6,601,271 B1 * 8/2003 Sommerfeld et al. ..... 16/427
6,743,155 B2 * 6/2004 Pan ..... 482/54
6,821,230 B2 * 11/2004 Dalebout et al. ..... 482/51
6,872,169 B2 * 3/2005 Kuo ..... 482/54
7,563,203 B2 * 7/2009 Dalebout et al. ..... 482/54
7,828,699 B2 * 11/2010 P'erez De Lazarraga ..... 482/54
8,002,294 B2 * 8/2011 Brandeau ..... 280/80.1
2002/0183170 A1 * 12/2002 Wu ..... 482/54
2003/0027691 A1 * 2/2003 Pan ..... 482/54
2004/0176217 A1 * 9/2004 Watterson et al. ..... 482/54

FOREIGN PATENT DOCUMENTS

TW 281082 7/1996
TW M257845 3/2005

* cited by examiner

*Primary Examiner* — Loan H Thanh
*Assistant Examiner* — Garrett Atkinson
(74) *Attorney, Agent, or Firm* — Huffman Law Group, PC

(57) ABSTRACT

A treadmill includes a tread platform having two longitudinal frame bars, a swing unit pivotally mounted at the bottom side of the tread platform, and two inclination angle adjustment blocks. Each inclination angle adjustment block has a core shaft defining an axis line, and a plurality of bearing faces connected to one another and respectively disposed in parallel to the axis line and adapted for selectively supporting the tread platform on the ground. Each bearing face defines with the axis line a respective different vertical distance. The core shafts of the inclination angle adjustment blocks are pivotally coupled to the swing unit to support the inclination angle adjustment blocks at an outer side relative to the longitudinal frame bars of the tread platform. Thus, the treadmill allows manual multi-angle adjustment of the angle of inclination of the tread platform.

8 Claims, 8 Drawing Sheets

TREADMILL

BACKGROUND OF THE INVENTION

1. Field of the Invention

The present invention relates to treadmills and more particularly, to such a treadmill that allows manual multi-angle adjustment of the angle of inclination of the tread platform.

2. Description of the Related Art

With the modern busy lifestyles, indoor exercise has become a trend nowadays. Among fitness enthusiasts, treadmill is one of the most popular fitness equipment.

The tread platforms of conventional treadmills commonly have a fixed angle of inclination that cannot satisfy the preferences of different users, or enhance the training of particular muscles. Thus, the use of conventional treadmills is monotonous and cannot evenly train different muscles.

In order for a user to adjust the angle of inclination of the tread platform in simulating different road conditions subject to personal requirements, the present applicant invented a design for the adjustment of the angle of inclination of the tread platform, as disclosed in Taiwan Patent M257845. This design has the advantages of simple structure and ease of operation. However, the adjustable angular positions of the tread platform are limited. There is still room for improvement. Further, many treadmills with electric multi-angle tread platform adjustment means are commercially available. However, these designs are commonly expensive.

SUMMARY OF THE INVENTION

The present invention has been accomplished under the circumstances in view. It is the main object of the present invention to provide a treadmill, which allows manual adjustment of the inclined angle of the tread platform in one of a series of angular positions conveniently and rapidly.

To achieve this and other objects of the present invention, a treadmill comprises a tread platform having two longitudinal frame bars bilaterally disposed at a bottom side thereof, a swing unit pivotally mounted at the bottom side of the tread platform and biasable relative to the tread platform between an outer position relatively closer to respective rear ends of the longitudinal frame bars and an inner position relatively far from the rear ends of the longitudinal frame bars, and two inclination angle adjustment blocks. Each inclination angle adjustment block comprises a core shaft defining an axis line, and a plurality of bearing faces connected to one another and respectively disposed in parallel to the axis line and adapted for selectively supporting the tread platform on the ground. Each bearing face defines with the axis line a respective vertical distance. At least two vertical distances are different. The core shafts of the inclination angle adjustment blocks are pivotally coupled to the swing unit to support the inclination angle adjustment blocks at an outer side relative to the longitudinal frame bars of the tread platform.

As the treadmill of the invention allows adjustment of the angle of inclination of the tread platform relative to the ground by means of changing the position of the inclination angle adjustment blocks and rotating them relative to the axle(s), the tread platform can be adjusted to one of a large number of different inclined angles.

Further, in one embodiment of the present invention, the swing unit comprises an axle transversely disposed at a bottom side relative to the longitudinal frame bars of said tread platform, and two links extended from the periphery of the axle and respectively pivotally connected to the longitudinal frame bars of the tread platform. The axle has two opposite ends thereof respectively protruding over the respective longitudinal frame bars. Further, the core shafts of the inclination angle adjustment blocks are pivotally mounted on the axle near the two opposite ends thereof Further, the swing unit can be made comprising two axles and two links. The axles are disposed at a bottom side relative to the longitudinal frame bars of the tread platform. Each axle has an outer end thereof respectively protruding over the corresponding longitudinal frame bar. The two links are respectively extended from the axles and respectively pivotally connected to the longitudinal frame bars of the tread platform. Further, the core shafts of the inclination angle adjustment blocks are respectively pivotally mounted on the axles near the outer end of the respective axle.

Further, each inclination angle adjustment block comprises a plurality of petals connected to one another around the core shaft thereof Further, the petals of each inclination angle adjustment block have different sizes.

Further, each petal of each inclination angle adjustment block comprises an arched segment, a straight segment connected between the arched segment and the bent segment. The straight segment of each petal of each inclination angle adjustment block defines one respective bearing face. Alternatively, the straight segment of one said petal and the arched segment of one adjacent petal define one respective bearing face.

Further, the swing unit further comprises two cushion members respectively disposed below the longitudinal frame bars of the tread platform and adapted for stopping against the longitudinal frame bars respectively.

Further, the two cushion members can be respectively mounted on the axle between the inclination angle adjustment blocks and the links.

Other advantages and features of the present invention will be fully understood by reference to the following specification in conjunction with the accompanying drawings, in which like reference signs denote like components of structure.

DETAILED DESCRIPTION OF THE INVENTION

Figure 1:
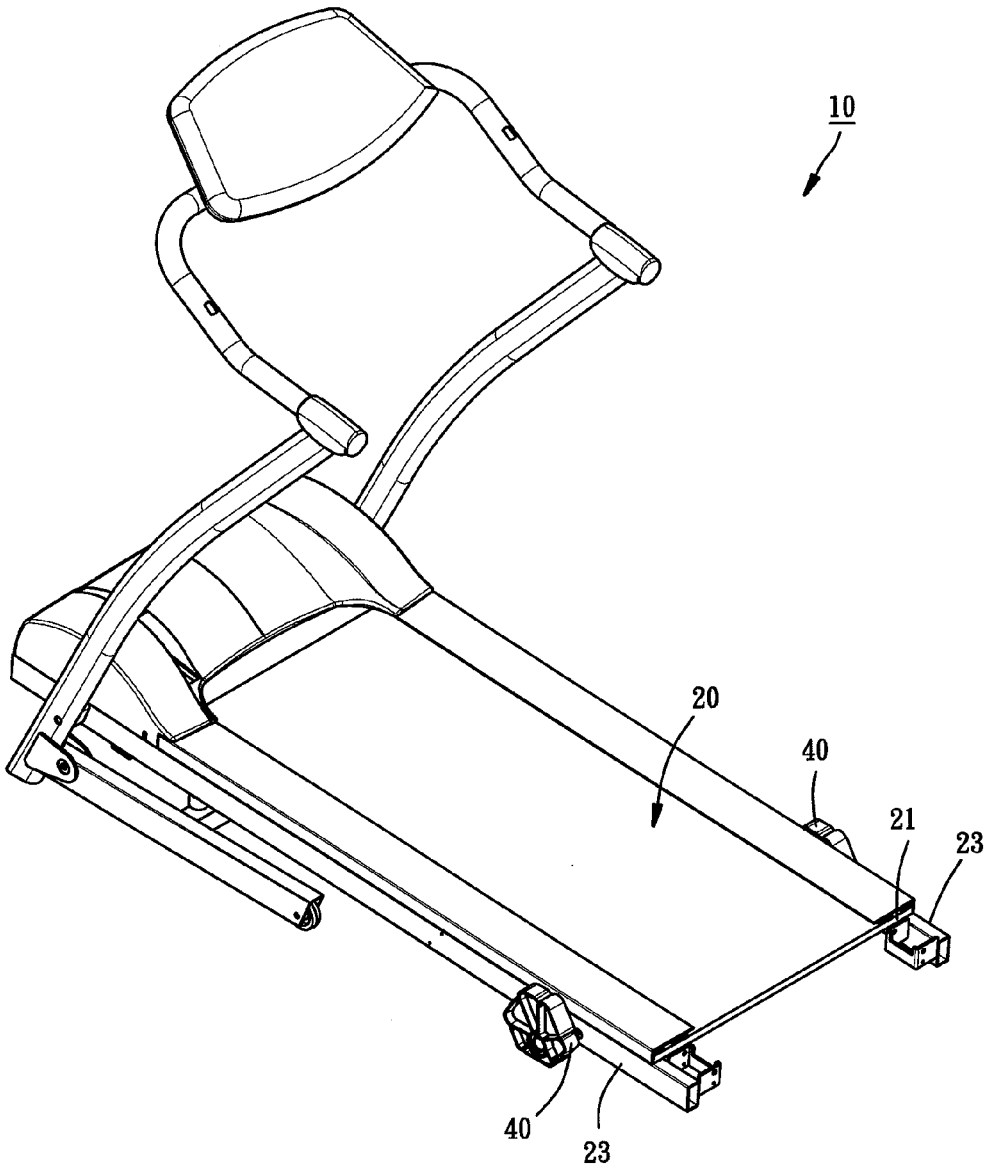
FIG. 1 is an oblique top elevational view of a treadmill in accordance with a first embodiment of the present invention.
Figure 2:
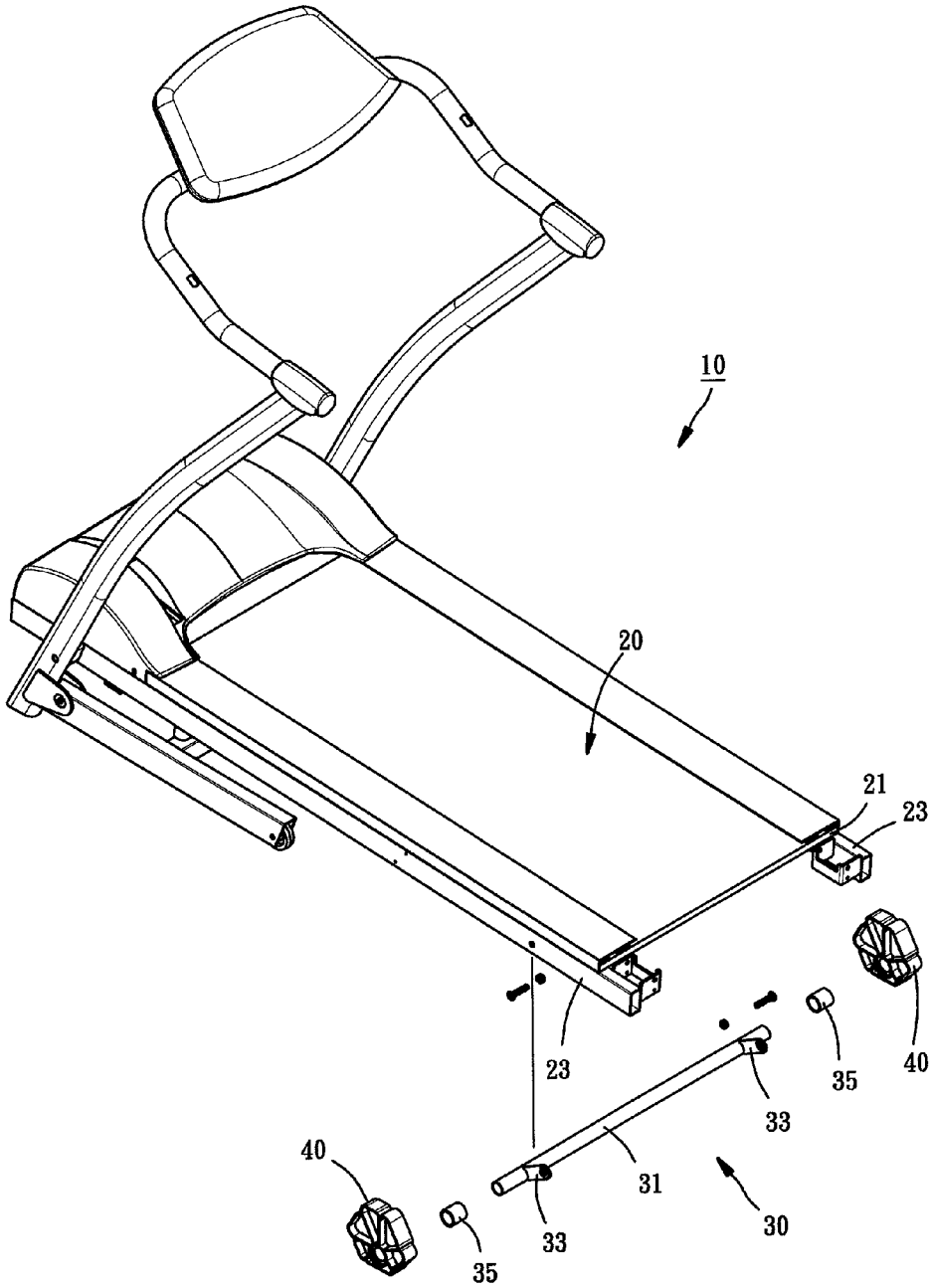
FIG. 2 is an exploded view of the treadmill in accordance with the first embodiment of the present invention.
Figure 3:
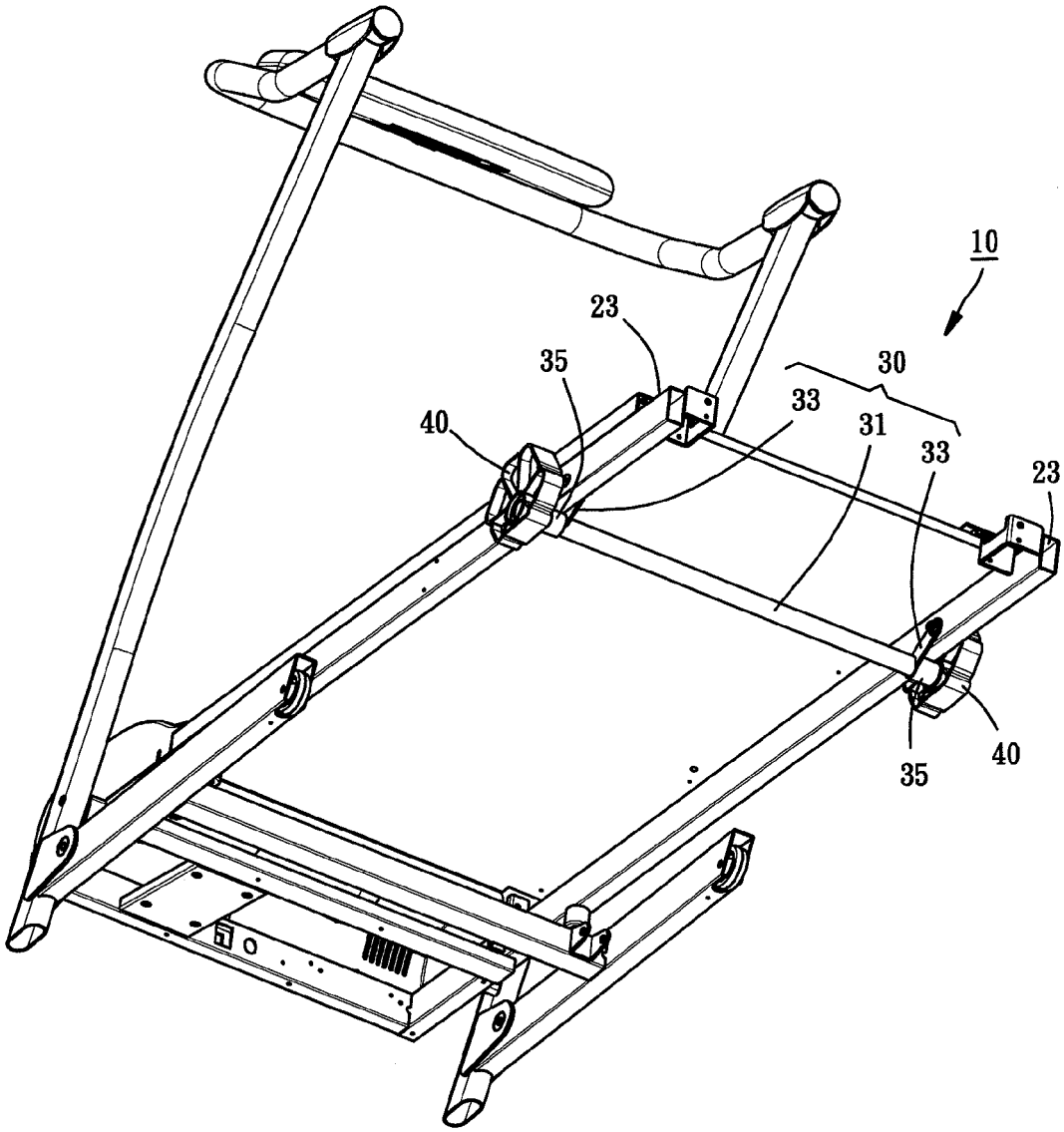
FIG. 3 is an oblique bottom elevational view of the treadmill in accordance with the first embodiment of the present invention.

Referring to FIGS. 1-3, a treadmill 10 in accordance with the present invention is shown comprising a tread platform 20, a swing unit 30, and two inclination angle adjustment blocks 40.

The tread platform 20 comprises a base frame 21, and two longitudinal frame bars 23 mounted at the bottom side of the base frame 21 and respectively extending along two opposite lateral sides of the base frame 21.

The swing unit 30 comprises an axle 31 and two links 33. The axle 31 and the links 33 are made of metal. The links 33 are kept apart at a predetermined distance, each having one end thereof fixedly fastened to the axle 31 by, for example, welding process.

Figure 4:
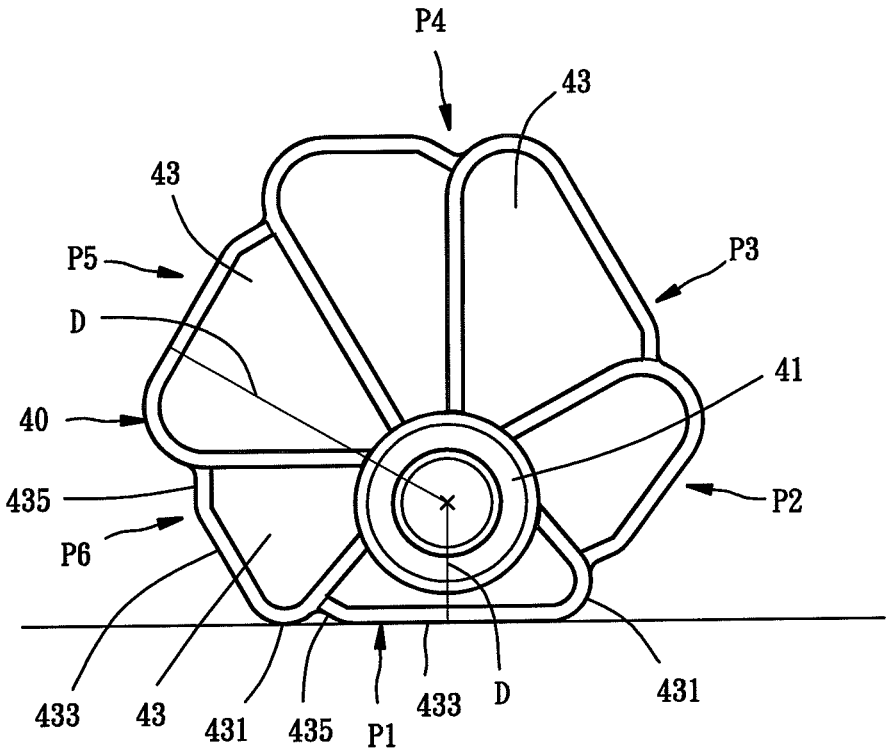
FIG. 4 is a side view of a part of the treadmill in accordance with the first embodiment of the present invention, illustrating the configuration of the inclination angle adjustment block.

The inclination angle adjustment blocks 40 are slightly elastic and shaped like a flower, as shown in FIG. 4. This flower-like configuration is simply an example but not a limitation. Each inclination angle adjustment blocks 40 comprises a core shaft 41, 6 petals 43, and 6 bearing faces P1~P6.

The petals 43 are different in size, and respectively outwardly extended from the periphery of the core shaft 41 and connected to one another. Each petal 43 defines an arched segment 431, a straight segment 433 and a bent segment 435. The bent segment 435 of each petal 43 is integrally connected to the arched segment 431 of one adjacent petal 43. Further, the straight segment 433 of each petal 43 and the arched segment 431 of one adjacent petal 43 define one of the bearing faces P1~P6. In actual fabrication, the petals 43 can be so configured that the straight segments 433 define the bearing faces P1~P6 respectively.

Further, the bearing faces P1~P6 are respectively disposed in parallel to an axis line of the core shaft 41; the vertical distances D defined between the bearing faces P1~P6 and the axis line of the core shaft 41 are different. In actual application, the petals 43 can be so designed that only two different vertical distances D are defined between the bearing faces P1~P6 and the axis line of the core shaft 41.

During installation, as shown in FIGS. 2 and 3, pivotally connect the links 33 to the longitudinal frame bars 23 by: inserting a respective screw bolt through each longitudinal frame bar 23 near its rear end and a through hole on the respective link 33 and then threading a respective screw nut on each screw bolt. At this time, the axle 31 is disposed below the longitudinal frame bars 23 and near their rear ends, and the two opposite ends of the axle 31 respectively protrude over the respective outer sides of the longitudinal frame bars 23. Thus, the swing unit 30 can be biased relative to the longitudinal frame bars 23 between an outer position close to the rear ends of the longitudinal frame bars 23 and an inner position away from the rear ends of the longitudinal frame bars 23. Further, the core shafts 41 of the inclination angle adjustment blocks 40 are respectively press-fitted onto the two opposite ends of the axle 31. Thus, the inclination angle adjustment blocks 40 are respectively kept at a rear outer side relative to the longitudinal frame bars 23 (see FIG. 1). As the inclination angle adjustment blocks 40 are slightly elastic, they can be positively secured to the axle 31 and rotated relative to the axle 31 to selectively shift one of the bearing faces P1~P6 into contact with the ground G. Further, axle bearings may be used to positively support the core shafts 41 of the inclination angle adjustment blocks 40 on the axle 31, allowing the inclination angle adjustment blocks 40 to be rotated relative to the axle 31.

Figure 5:
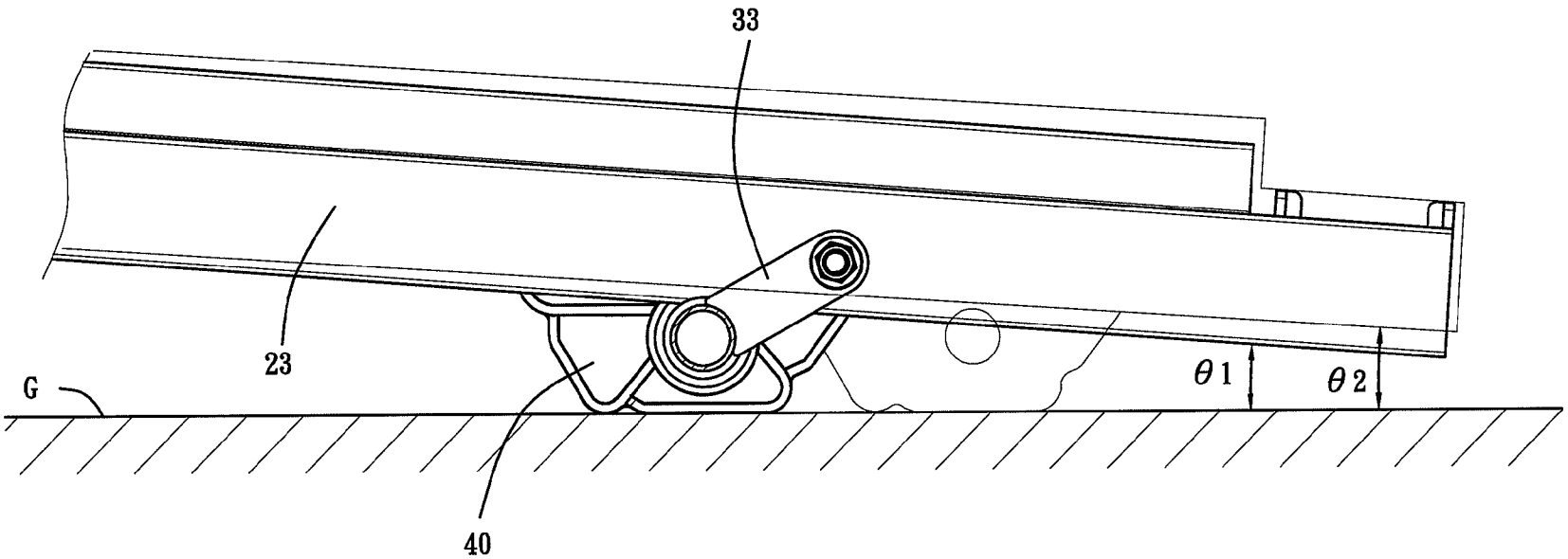
FIG. 5 is a schematic drawing illustrating the track of the position shifts of the inclination angle adjustment blocks.

Thus, as shown in FIG. 5, when biasing the swing unit 30 relative to the longitudinal frame bars 23, the inclination angle adjustment blocks 40 are moved with the swing unit 30 between the outer position close to the rear ends of the longitudinal frame bars 23 and the inner position away from the rear ends of the longitudinal frame bars 23 to adjust the angle of inclination of the tread platform 20 relative to the ground G, i.e., the angle of inclination $\theta_1$ defined between the tread platform 20 and the ground G as the inclination angle adjustment blocks 40 are in the inner position away from the rear ends of the longitudinal frame bars 23 is smaller than the angle of inclination $\theta_2$ defined between the tread platform 20 and the ground G as the inclination angle adjustment blocks 40 are in the outer position close to the rear ends of the longitudinal frame bars 23.

Figure 7:
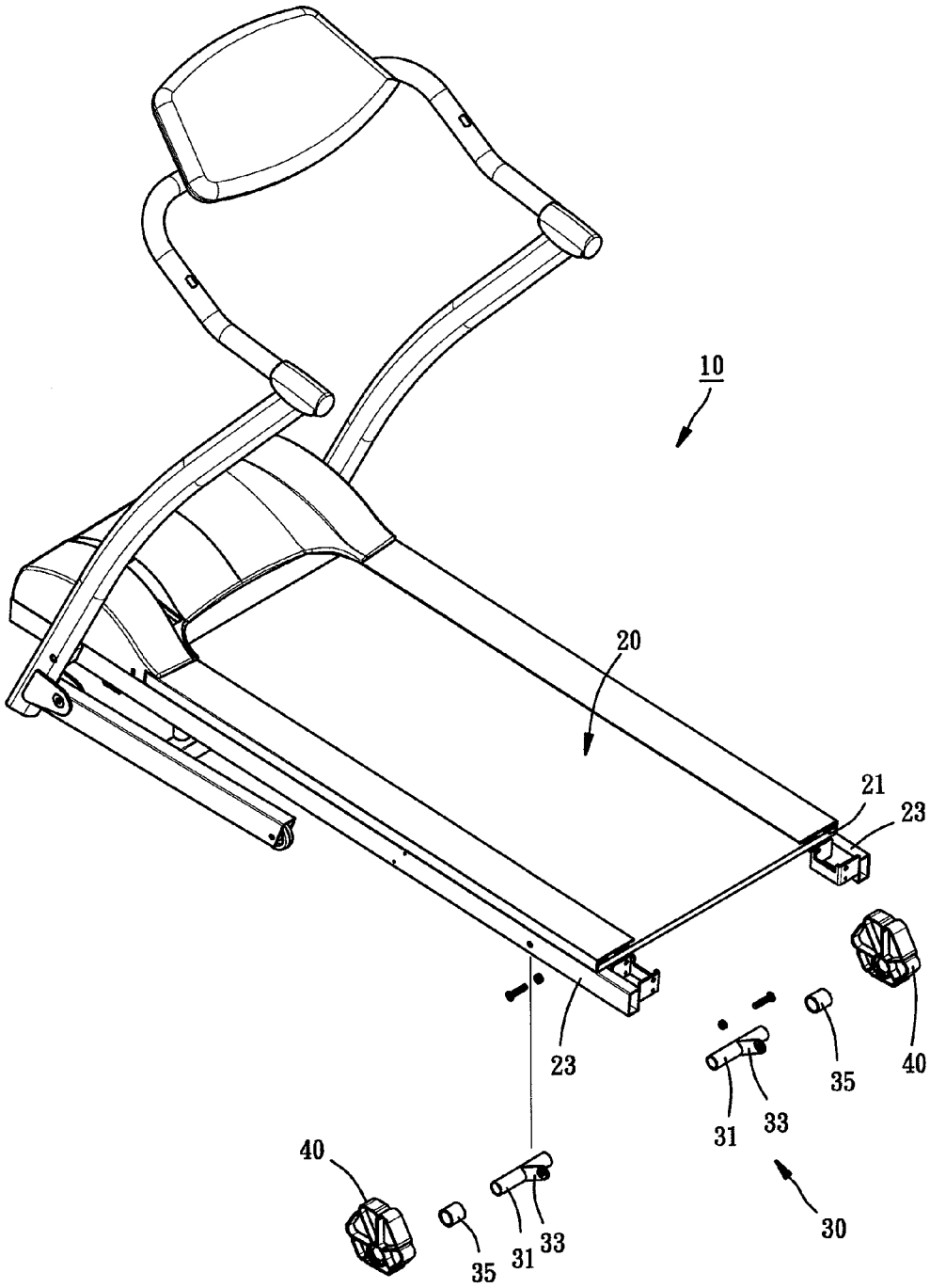
FIG. 7 is an exploded view of a treadmill in accordance with a second embodiment of the present invention.

In this embodiment, the swing unit 30 comprises an axle 31 and two links 33 that are welded together. This embodiment allows synchronous adjustment of the position of the two inclination angle adjustment blocks 40. For asymmetric adjustment of the two inclination angle adjustment blocks 40, an alternate form of the swing unit 30 in accordance with a second embodiment of the present invention is shown in FIG. 7. As illustrated, the swing unit 30 in accordance with the second embodiment of the present invention comprises two axles 31, and two links 33 respectively fixedly connected to the axles 31.

Figure 6A:
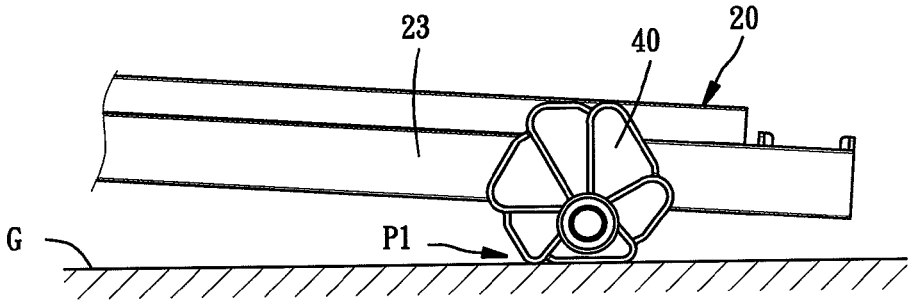
FIGS. 6A~6F illustrate the adjustment of the angle of inclination of the tread platform subject to change of the position and angle of the inclination angle adjustment blocks.
Figure 6B:
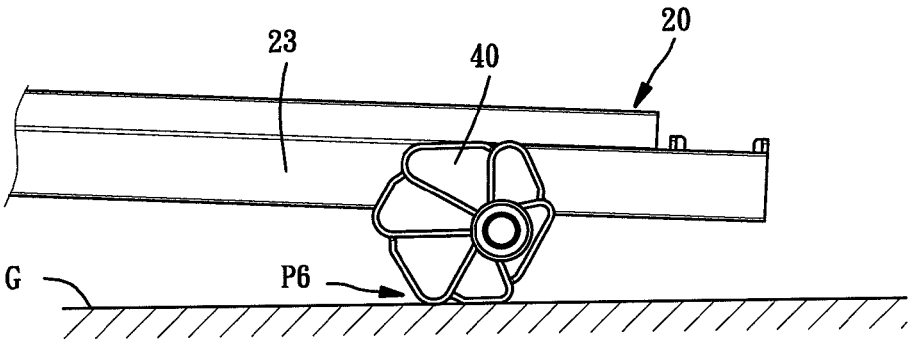
Figure 6C:
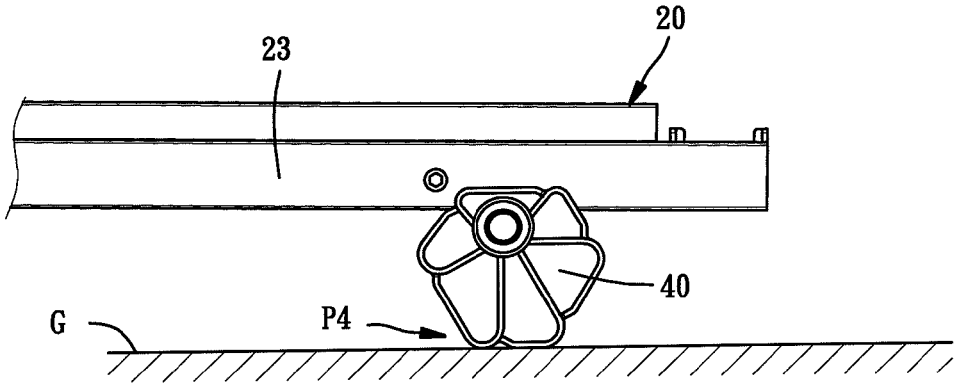
Figure 6D:
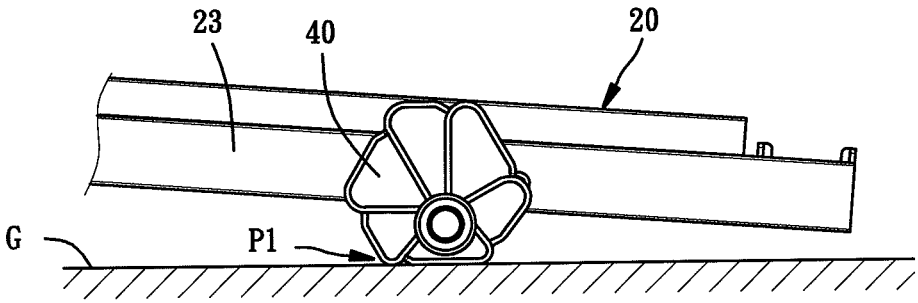
Figure 6E:
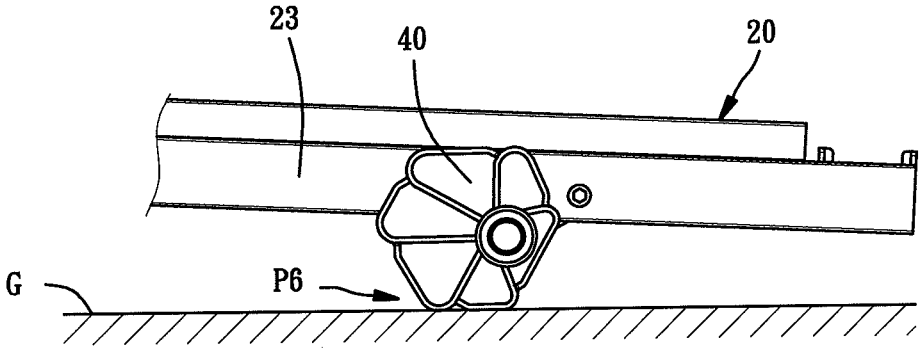
Figure 6F:
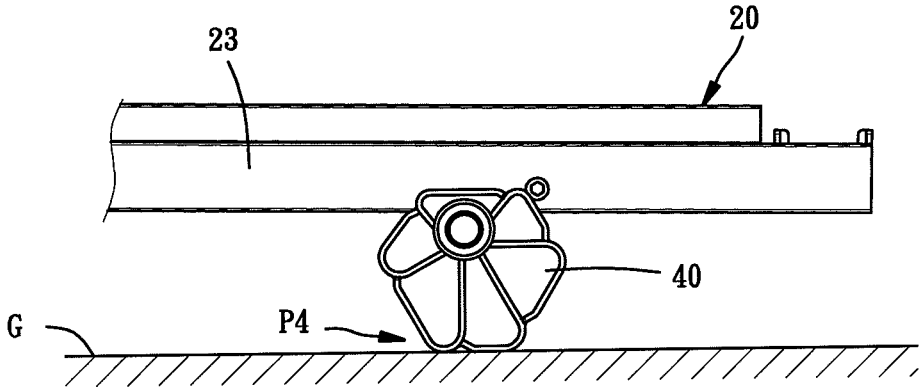

During application of the present invention, as shown in FIGS. 6A through 6F, the inclination angle adjustment blocks 40 can be selectively set in one of a series of positions. FIGS. 6A through 6C illustrate the inclination angle adjustment blocks 40 moved in counter-clockwise direction from the outer position close to the rear ends of the longitudinal frame bars 23 to the position where the bearing faces P1, P6 or P4 is kept into contact with the ground G. FIGS. 6D and 6E illustrate the inclination angle adjustment blocks 40 moved in counter-clockwise direction from the inner position far from the rear ends of the longitudinal frame bars 23 to the position where the bearing faces P1, P6 or P4 is kept into contact with the ground G. As shown in FIGS. 6A through 6F, changing the position of the inclination angle adjustment blocks 40 toward or away from the rear ends of the longitudinal frame bars 23 or rotating the inclination angle adjustment blocks 40 relative to the longitudinal frame bars 23 to selectively shift one of the bearing faces P1~P6 into contact with the ground G can adjust the angle of inclination of the tread platform 20. According to the aforesaid two embodiments where the inclination angle adjustment blocks 40 have 6 bearing faces P1~P6, the tread platform 20 of the treadmill 10 is selectively adjustable to one of 12 inclined positions. It is to be understood that the aforesaid number of bearing faces is simply an example but not a limitation, i.e., the number of bearing faces can be increased or reduced subject to actual requirements.

Further, as shown in FIGS. 2 and 3, two cushion members 35 are attached to the swing unit 30 of the treadmill 10. These two cushion members 35 are respectively mounted at (for example, sleeved onto) the axle 31 between the inclination angle adjustment blocks 40 and the links 33 for stopping against the longitudinal frame bars 23 to absorb shocks during adjustment of the position of the inclination angle adjustment blocks 40.

In conclusion, the treadmill 10 allows multi-angle position adjustment of the angle of inclination of the tread platform 20 relative to the ground G by means of changing the position of the inclination angle adjustment blocks 40 toward or away from the rear ends of the longitudinal frame bars 23 or rotating the inclination angle adjustment blocks 40 relative to the longitudinal frame bars 23. Further, the design of the swing unit 30 consisting of two links 33 and one axle 31 enables the user to adjust the position of the inclination angle adjustment blocks 40 conveniently. Further, the arrangement of the cushion members 35 of the swing unit 30 for stopping against the longitudinal frame bars 23 to absorb shocks during adjustment of the position of the inclination angle adjustment blocks 40 effectively protects the axle 31 from damage.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A treadmill, comprising:

a tread platform comprising two longitudinal frame bars bilaterally disposed at a bottom side thereof;

a swing unit pivotally mounted at a bottom side of said tread platform and biasable relative to said tread platform between an outer position relatively closer to respective rear ends of said longitudinal frame bars and an inner position relatively far from said rear ends of said longitudinal frame bars; and two inclination angle adjustment blocks, each said inclination angle adjustment block comprising a core shaft defining an axis line, and a plurality of bearing faces connected to one another and respectively disposed in parallel to said axis line and adapted for selectively supporting said tread platform on a ground, said bearing faces defining with said axis line a respective vertical distance, at least two said vertical distances being different, the core shafts of said inclination angle adjustment blocks being pivotally coupled to said swing unit to support said inclination angle adjustment blocks at an outer side relative to said longitudinal frame bars of said tread platform;

wherein each said inclination angle adjustment block comprises a plurality of petals connected to one another around the core shaft thereof, and the petals of each said inclination angle adjustment block having different sizes.

2. The treadmill as claimed in claim 1, wherein said swing unit comprises an axle transversely disposed at a bottom side relative to said longitudinal frame bars of said tread platform, said axle having two opposite ends thereof respectively protruding over the respective longitudinal frame bars, and two links extended from the periphery of said axle and respectively pivotally connected to said longitudinal frame bars of said tread platform; said core shafts of said inclination angle adjustment blocks are pivotally mounted on said axle near the two opposite ends thereof.

3. The treadmill as claimed in claim 2, wherein said swing unit further comprises two cushion members respectively mounted on said axle between said inclination angle adjustment blocks and said links and adapted for stopping against said longitudinal frame bars respectively.

4. The treadmill as claimed in claim 1, wherein said swing unit comprises two axles disposed at a bottom side relative to said longitudinal frame bars of said tread platform, each said axle having an outer end thereof respectively protruding over the corresponding longitudinal frame bar, and two links respectively extended from said axles and respectively pivotally connected to said longitudinal frame bars of said tread platform; the core shafts of said inclination angle adjustment blocks are pivotally mounted on said axles near the outer end of the respective axle.

5. The treadmill as claimed in claim 4, wherein said swing unit further comprises two cushion members respectively mounted on said two axles between said inclination angle adjustment blocks and said links and adapted for stopping against said longitudinal frame bars respectively.

6. The treadmill as claimed in claim 1, wherein each petal of each said inclination angle adjustment block comprises a straight segment defining one said bearing face.

7. The treadmill as claimed in claim 1, wherein each petal of each said inclination angle adjustment block comprises an arched segment, a straight segment connected between said arched segment and said bent segment, the straight segment of one said petal and the arched segment of one adjacent said petal defining one said bearing face.

8. The treadmill as claimed in claim 1, wherein said swing unit further comprises two cushion members respectively disposed below said longitudinal frame bars of said tread platform and adapted for stopping against said longitudinal frame bars respectively.

* * * * *